US009991586B2

(12) United States Patent
Hsu et al.

(10) Patent No.: US 9,991,586 B2
(45) Date of Patent: Jun. 5, 2018

(54) PORTABLE ELECTRONIC DEVICE

(71) Applicant: ASUSTeK COMPUTER INC., Taipei (TW)

(72) Inventors: Chien-Ming Hsu, Taipei (TW); Wang-Ta Hsieh, Taipei (TW); Kuei-Shun Yeh, Taipei (TW); Shih-Chia Chiu, Taipei (TW); Chuan-Chien Huang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 9 days.

(21) Appl. No.: 15/376,677

(22) Filed: Dec. 13, 2016

(65) Prior Publication Data

US 2017/0179575 A1 Jun. 22, 2017

(30) Foreign Application Priority Data

Dec. 22, 2015 (CN) ..... 2015 1 0991116

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 9/42*** | (2006.01) |
| ***H01Q 21/28*** | (2006.01) |

(52) U.S. Cl.

CPC ..... *H01Q 1/243* (2013.01); *H01Q 1/241* (2013.01); *H01Q 1/242* (2013.01); *H01Q 1/38* (2013.01); *H01Q 1/48* (2013.01); *H01Q 9/42* (2013.01); *H01Q 21/28* (2013.01)

(58) Field of Classification Search

CPC ..... H01Q 1/24; H01Q 1/241; H01Q 1/242; H01Q 1/38; H01Q 1/48; H01Q 9/42; H01Q 21/28

See application file for complete search history.

(56) References Cited

U.S. PATENT DOCUMENTS

2014/0139379 A1* 5/2014 Bolin ..... H01Q 1/243 343/702

2014/0300518 A1* 10/2014 Ramachandran ..... H01Q 1/243 343/702

* cited by examiner

*Primary Examiner* — Hoang Nguyen

(74) *Attorney, Agent, or Firm* — JCIPRNET

(57) ABSTRACT

A portable electronic device including a front cover, a back cover and a circuit board is provided. The circuit board is located between the front cover and the back cover. The back cover is combined with the front cover and includes a back section, a plurality of side sections and a separator, at least one of the side sections adjacent to the back cover includes a groove close to the back section and a slot far away from the back section, the slot is connected through to the groove, a first antenna unit and a second antenna unit are defined at the side section by the groove and the slot. The separator is located in the groove and the slot.

10 Claims, 6 Drawing Sheets

PORTABLE ELECTRONIC DEVICE

CROSS-REFERENCE TO RELATED APPLICATION

This application claims the priority benefit of China application serial No. 201510991116.0, filed on Dec. 22, 2015. The entirety of the above-mentioned patent application is hereby incorporated by reference herein and made a part of specification.

BACKGROUND OF THE INVENTION

Field of the Invention

The present invention relates to an electronic device and, more particularly, to a portable electronic device with an antenna.

Description of the Related Art

With the development of science and technology, wireless communication of electronic devices is currently provided by antennas. The electronic devices are such as a cell phone, a Personal Digital Assistant (PDA), a Global Positioning System (GPS).

BRIEF SUMMARY OF THE INVENTION

According to first aspect of the disclosure, a portable electronic device is disclosed. The portable electronic device comprises: a front cover; a back cover combined with the front cover; and a circuit board located between the front cover and the back cover. The back cover includes a back section, a plurality of side sections adjacent to the back section and separator. Wherein at least one of the side sections includes a groove close to the back section and a slot far away from the back section. The slot is connected through to the groove. A first antenna unit and a second antenna unit are defined at the side section by the groove and the slot. The separator is located in the groove and the slot.

In sum, a groove and a slot are formed at least one of the side sections of the back cover of the portable electronic device. A first antenna unit and a second antenna unit are formed at the side section to provide the wireless communication. Therefore, an antenna and a support board for the antenna is no longer needed to be configured inside the portable electronic device, and then the portable electronic device can become thinner. Moreover, since the first antenna unit and the second unit are formed at the side sections, the consistency in the overall appearance of the back cover is maintained.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
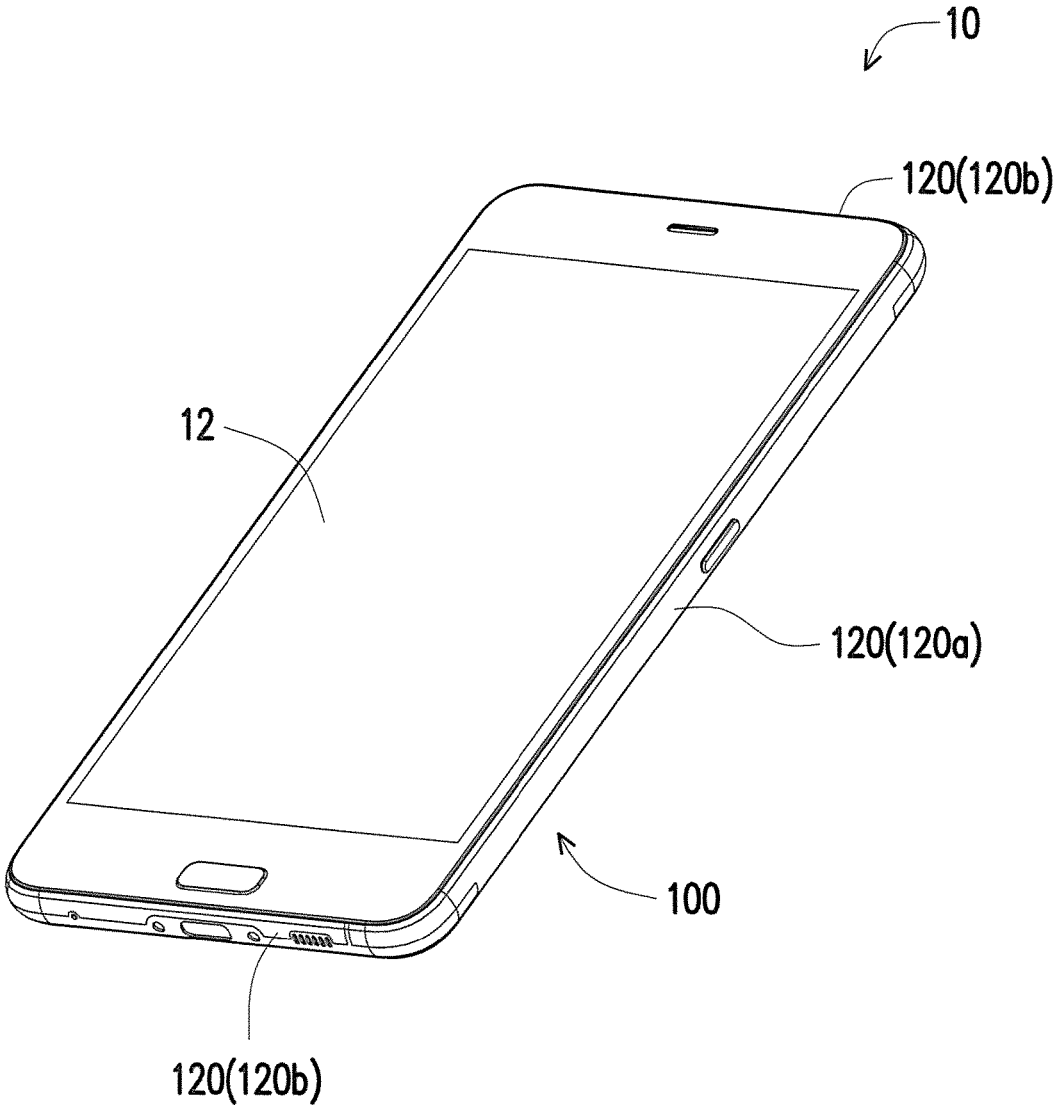
FIG. 1 is a schematic view of the portable electronic device according to an embodiment.

FIG. 1 is a schematic view of the portable electronic device according to an embodiment. Referring to FIG. 1, in the embodiment, the portable electronic device 10 is a cell phone, and the portable electronic device 10 also may be a tablet computer or other electronic devices, which is not limited herein. In an embodiment, the portable electronic device 10 includes a front cover 12 (such as a glass cover) and a back cover 100 combined together.

The back cover 100 includes a plurality of side sections 120, in an embodiment, the side sections 120 include two first side sections 120*a* and two second side sections 120*b*, the length of the first side sections 120*a* is longer than the length of the second side sections 120*b*. In an embodiment, an antenna unit is configured at one of the second side sections 120*b* (such as the second side section 120*b* located at the bottom of the portable electronic device 10 in FIG. 1) of the back cover 100 to provide wireless communication. Consequently, the internal antenna and the board for the internal antenna are omitted to reduce the thickness of the portable electronic device 10. Moreover, since the antenna unit is located in the second side section 120*b* of the back cover 100, no extra holes and grooves are needed, the back section 110 of the back cover 100 would have a consistent appearance. The structure of the back cover 100 in embodiments is illustrated in details hererinafter.

Figure 2:
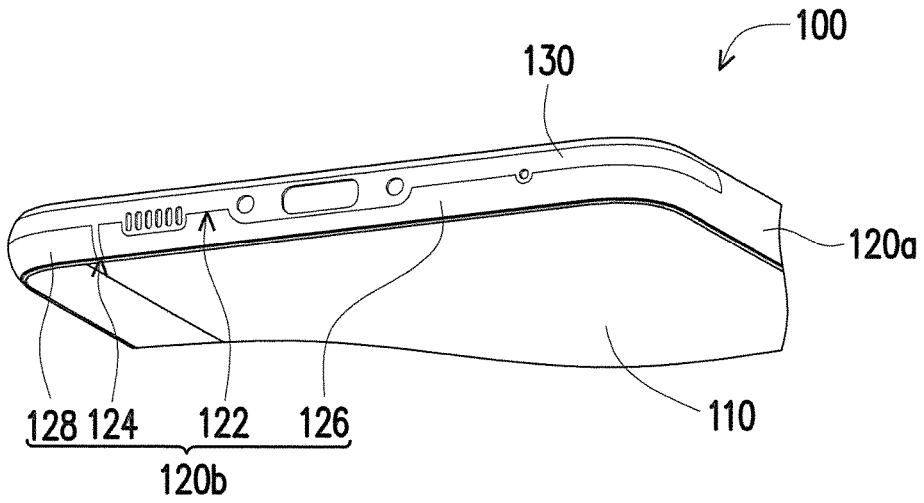
FIG. 2 and FIG. 3 are schematic views of the back cover of the portable electronic device in FIG. 1 from different angles of view.
Figure 3:
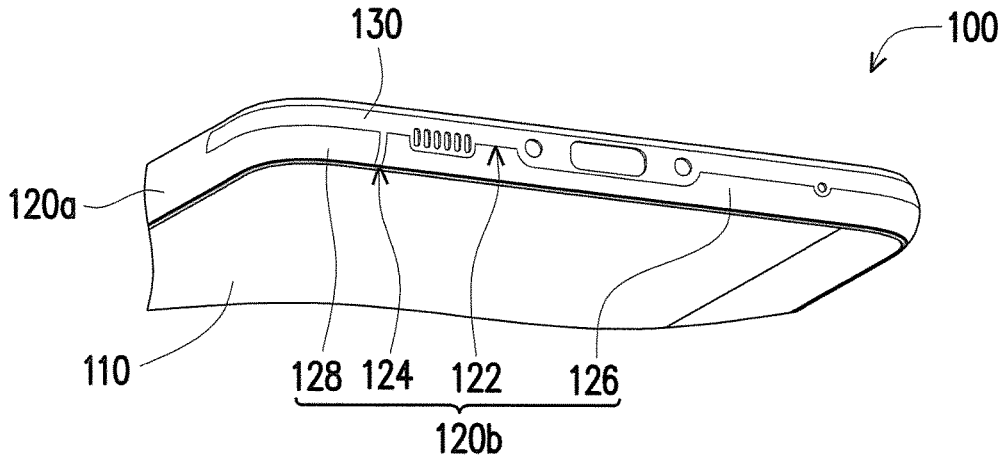

FIG. 2 and FIG. 3 are schematic views of the back cover of the portable electronic device in FIG. 1 from different angles of view, respectively. FIG. 2 and FIG. 3 are bottom views of a back section 110 of the back cover 100. Refer to FIG. 1 to FIG. 3, the back cover 100 includes an back section 110, four side sections 120 (including two first side sections 120*a* and two second side sections 120*b*) and a separator 130, the four side sections 120 are adjacent to the back section 110. In an embodiment, the second side section 120*b* of the back cover 100 is separated from the back section 110 to form an antenna, the other three side sections 120 (including two first side sections 120*a* and one second side section 120*b*) are connected to the back section 110. In an embodiment, each of the two second side sections 120*b* forms an antenna, respectively, and two first side sections 120*a* are connected to the back section 110.

Moreover, in an embodiment, the material of the back section 110 and the four side sections of the back cover 100 are metal, the side section 120 in FIG. 2 and FIG. 3 includes a groove 122 close to the back section 110 and an slot 124 far away from the back section 110, the slot 124 is connected through to the groove 122, a first antenna unit 126 and a second antenna unit 128 are defined at the side sections 120 via the groove 122 and the slot 124. The second antenna unit 128 and most of the first antenna unit 126 are located at the second side section 120*b*. In the embodiment, the back section 110 and the four side sections 120 are integratedly formed. That is, the first antenna unit 126 and the second antenna unit 128 are formed along with the manufacture of the back cover 100.

In an embodiment, the length ratio between the first antenna unit 126 and the second antenna unit 128 is between 3:1 to 5:1, to allow the first antenna unit 126 and the second antenna unit 128 capable of receiving or transmitting a radio signal of a desired frequency band (such as 2G/3G/4G). In an embodiment, the length of the first antenna unit 126 is about 60 mm, and the length of the second antenna unit 128 is 20 mm, the width of the first antenna unit 126 and the second antenna unit 128 are between 1 mm to 3 mm. Holes, such as a charging plug hole, a sound hole, and a speaker hole, are formed at the bottom side of the portable electronic device 100, thus, the groove 122 is formed corresponding to one of these holes to make the first antenna unit 126 and the second antenna unit 128 avoid these holes. In an embodiment, the width of the first antenna unit 126 and the second antenna unit 128 is decreased corresponding to the positions of these holes.

In an embodiment, the separator 130 is located inside the groove 122 and the slot 124 to maintain the integration of the back cover 100. In an embodiment, the material of the separator 130 is non-metal, such as plastic (for example, Polybutylene terephthalate (PBT)), which is not limited herein.

In an embodiment, partially of the back cover 100 is non-metallic. In an embodiment, only the side section 120 with the first antenna unit 126 and the second antenna unit 128 is made of metal, which is not limited herein.

Figure 4:
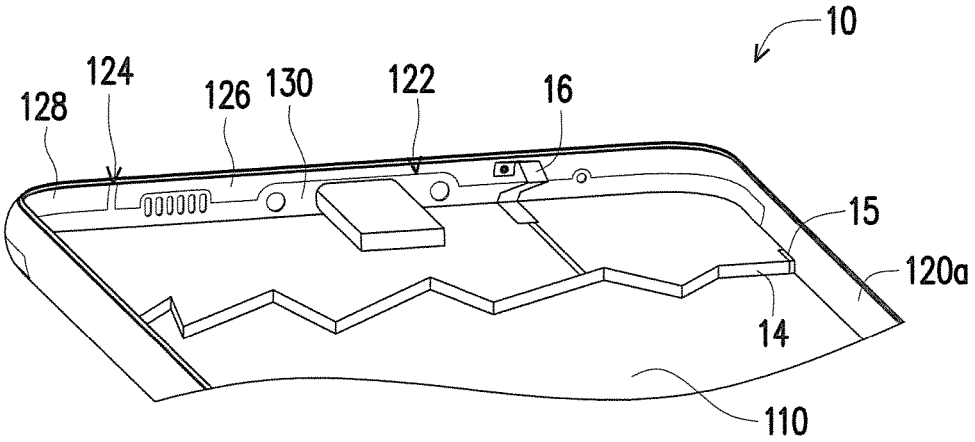
FIG. 4 is a schematic view of the portable electronic device in FIG. 1 omitting the front cover from another angle of view.

FIG. 4 is a schematic view of the portable electronic device in FIG. 1 omitting the front cover from another view angle. In the view angle of the FIG. 4, the back section 110 of the back cover 100 is located at the bottom in the figure. In the view angle of FIG. 4, only how the first antenna unit 120 is connected to a grounding pad 15 of the circuit board 14 is visible. In fact, the second antenna unit 128 is also connected to the other grounding pad 15 of the circuit board 14 in the same way.

Referring to FIG. 4, in an embodiment, the portable electronic device 10 further includes a circuit board 14 and a feeding metal piece 16. The circuit board 14 is configured between the front cover 12 (shown in FIG. 1) and back cover 100. The feeding metal piece 16 is connected to the circuit board 14 and the feeding end of the first antenna unit 126. The first antenna unit 126 and the second antenna unit 128 are connected to the grounding pad 15 of the circuit board 14, respectively. In an embodiment, the first antenna unit 126 and the second antenna unit 128 are connected to the adjacent first side sections 120*a*, respectively, the adjacent first side sections 120*a* contact with the grounding pad 15 of the circuit board 14, to make the first antenna unit 126 and the second antenna unit 128 connect to the grounding pads 15 of the circuit board 14. The way of the grounding of the first antenna unit 126 and the second antenna unit 128 are not limited herein.

The same or similar symbols denote the same or similar components, such as the cover 100*a*, 100*b*, 100*c*, or the portable electronic device 10*c* and 10*d*.

Figure 5:
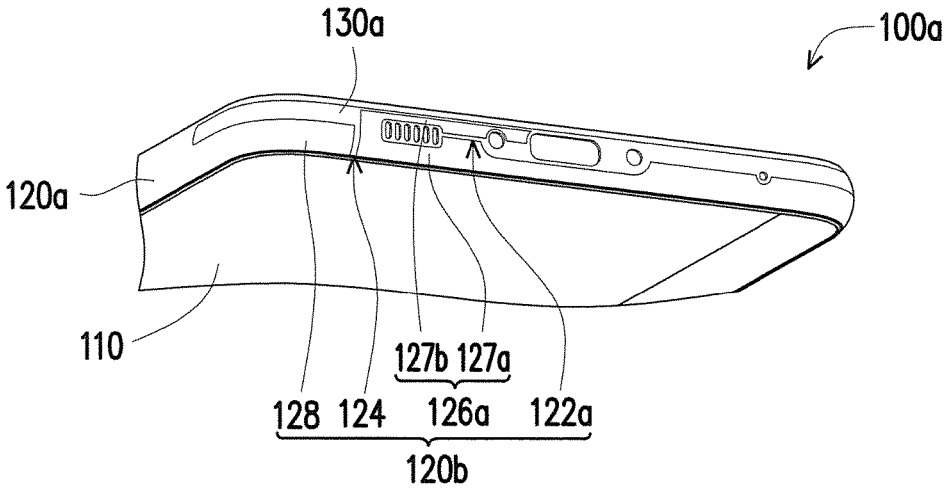
FIG. 5 is a schematic view of a back cover according to an embodiment.

FIG. 5 is a schematic view of a back cover according to an embodiment. Referring to FIG. 5, the main difference between the back cover 100*a* of FIG. 5 and the back cover 100 in FIG. 2 is the different shape of the first antenna unit 126*a*, due to the different shape of the first antenna unit 126*a*, the shapes of the groove 122*a* and the separator 130*a* are also changed accordingly.

In this embodiment, the part of the first antenna unit 126*a* close to the second antenna unit 128 includes a turn to form a first section 127*a* of the first antenna unit 126*a* and a second section 127*b* of the first antenna unit 126*a* which are arranged in parallel. The portable electronic device has different sizes, taking the small-size portable electronic device for example, if the length of the second side section 120*b* is not long enough, the required operating frequency band cannot be obtained. In this embodiment, the first antenna unit 126*a* has a hooked second section 127*b*, which makes the range of the frequency band corresponding to the first antenna unit 126*a* reduced, the required frequency band is thus obtained. In an embodiment, the second antenna unit 128 has a hooked section.

Figure 6:
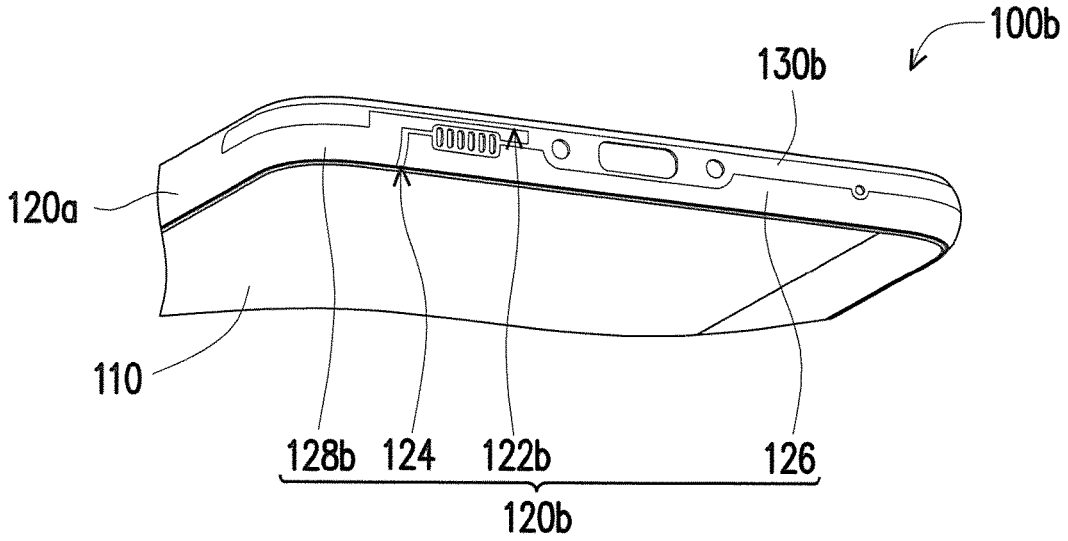
FIG. 6 is a schematic view of the back cover according to an embodiment.

FIG. 6 is a schematic view of the back cover according to an embodiment. Referring to FIG. 6, the main difference between the back cover 100*b* of FIG. 6 and the back cover 100 in FIG. 2 is that a part of the second antenna unit 128*b* has a turn near the end and extends toward the side of the first antenna unit 126 to be parallel to part of the first antenna unit 126. The shape of second antenna unit 128*b* of the back cover 100*b* is adjusted to adjust the coupling modal frequency, which makes the antenna more flexible. Similarly, the shapes of the groove 122*b* and the separator 130*b* are also changed with the change of the shape of the second antenna unit 128*b*. In an embodiment, a part of the first antenna unit 126 has a turn near the end of the second antenna unit 128*b* and extends towards the side of the second antenna unit 128*b*.

Figure 7:
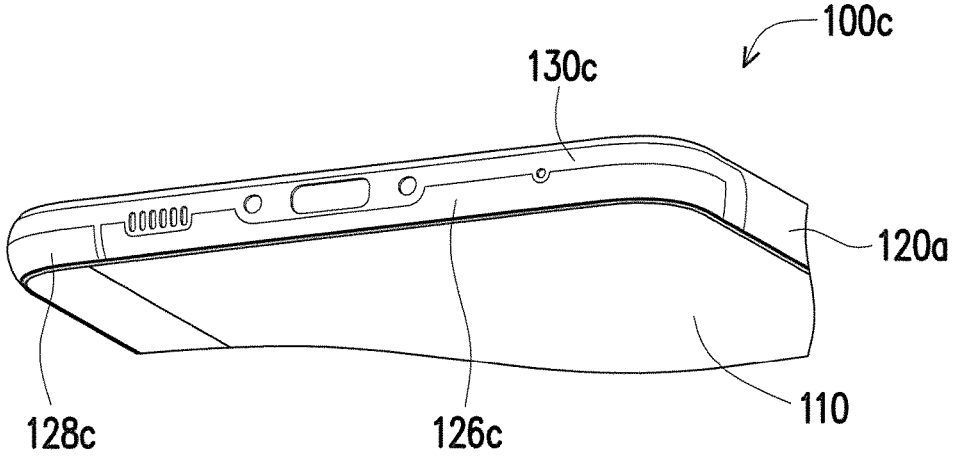
FIG. 7 is a schematic view of the back cover according to an embodiment.

FIG. 7 is a schematic view of the back cover according to an embodiment and

Figure 8:
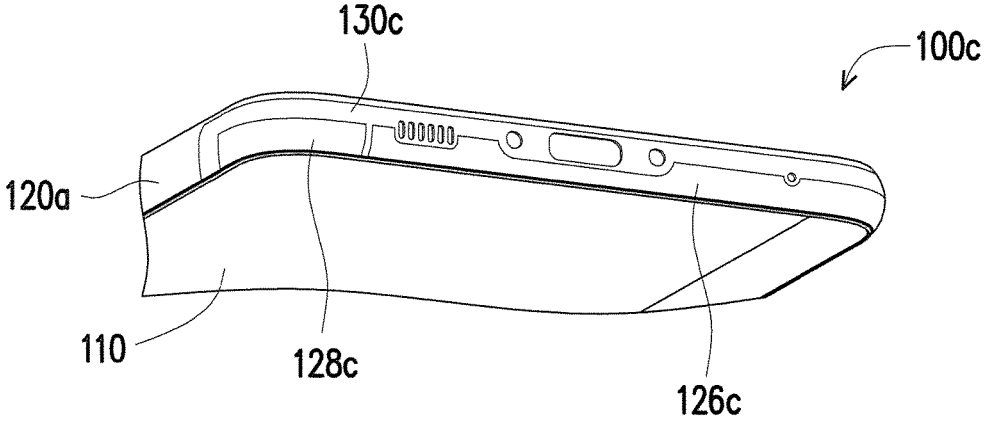
FIG. 8 is a schematic view of the back cover in FIG. 7 from different angle of view.

FIG. 8 is schematic view of the back cover in FIG. 7 from different angles of view. The difference between the back cover 100*c* of FIG. 7 and FIG. 8 and the cover 100 of FIG. 2 and FIG. 3 is as follows. In FIG. 2 and FIG. 3, the first antenna unit 126 and the second antenna unit 128 are connected to the adjacent first side sections 120*a*. In this embodiment, the first antenna unit 126*c* and the second antenna unit 128*c* are separated from these adjacent first side sections 120*a* via the separator 130*c*. In this configuration, the coupling modal frequency corresponding to the first antenna unit 126*c* and the second antenna unit 128*c* can be adjusted, and the antenna is more flexible. In another embodiment, only the first antenna unit 126*c* is separated from the adjacent first side section 120*a* by the separator 130*c*, or only the second antenna unit 128*c* is separated from the adjacent first side section 120*a* by the separator 130*c*.

Figure 9:
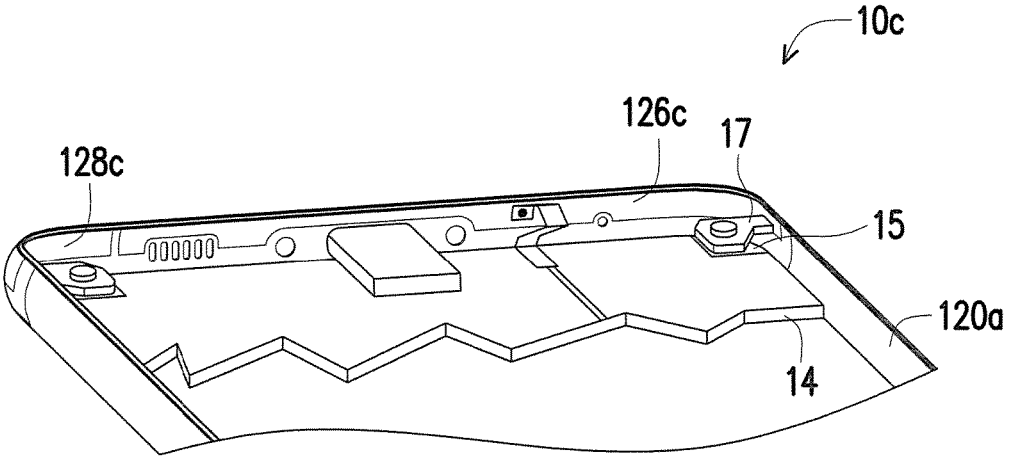
FIG. 9 is a schematic view of a portable electronic device omitting a front cover in an embodiment.

FIG. 9 is a schematic view of a portable electronic device omitting a front cover in an embodiment. Referring to FIG. 9, the difference between the portable electronic device 10*c* in FIG. 9 and the portable electronic device 10 in FIG. 4 is as follows. In FIG. 4, the first antenna unit 126 and the second antenna unit 128 are connected to the adjacent first side sections 120*a*, and then the side sections 120 are connected to the grounding pads 15 of the circuit board 14 to make the first antenna unit 126 and the second antenna unit 128 connected to the grounding pads 15 of the circuit board 14.

In FIG. 7 to FIG. 9, in the back cover 100*c* of the portable electronic device 10*c*, the first antenna unit 126*c* and the second antenna unit 128*c* are separated from the adjacent first side sections 120*a* via the separator 130*c*. Therefore, in an embodiment, the first antenna unit 126*c* and the second antenna unit 128*c* is not connected to the grounding pads 15 of the circuit board 14 via the adjacent first side sections 120*a*. In an embodiment, the portable electronic device 10*c* further includes a metal piece 17 such as a nut. The first antenna unit 126*c* is connected to the grounding pads 15 of the circuit board 14 by the metal piece 17. In an embodiment, the grounding pad 15 on the circuit board 14 is adjusted to the position close to the first antenna unit 126*c*.

Similarly, the second antenna unit 128*c* is connected to another grounding pad 15 of the circuit board 14 by another metal piece 17.

Figure 10:
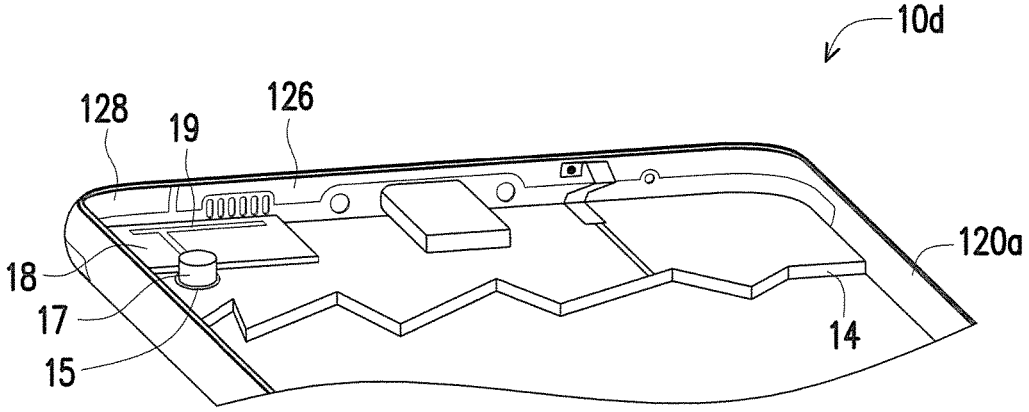
FIG. 10 is a schematic view of a portable electronic device omitting a front cover in an embodiment.

FIG. 10 is a schematic view of a portable electronic device omitting a front cover in an embodiment. Referring to FIG. 10, the main difference between the portable electronic device 10*d* in FIG. 10 and the portable electronic device 10 in FIG. 4 is that, the portable electronic device 10*d* further includes a support board 18 and a coupling antenna 19. The support board 18 is located at a side of the circuit board 18. The coupling antenna 19 is located on the support board 18, and the coupling antenna 19 is adjacent to the first antenna unit 126 or the second antenna unit 128. In the embodiment, the coupling antenna 19 is adjacent to the first antenna unit 126 and the second antenna unit 128, to couple to form an extra antenna operating mode with the first antenna unit 126 and the second antenna unit 128, and then the operating band is broader. Moreover, in an embodiment, the coupling antenna 19 is connected to the grounding pad 15 of the circuit board 14 via the metal piece 17 (such as a nut).

In sum, a groove and a slot are formed at at least one of the side sections of the back cover of the portable electronic device, and then a first antenna unit and a second antenna unit are formed at the side section to provide the wireless communication. Therefore, an antenna and a support board for the antenna is no longer needed to be configured inside the portable electronic device, and then the portable electronic device can be made thinner. Moreover, since the first antenna unit and the second unit are formed at the side sections, the consistency in the overall appearance of the back cover is maintained.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. A portable electronic device, comprising:

a front cover;

a back cover combined with the front cover, including:

a back section;

a plurality of side sections adjacent to the back section, wherein at least one of the side sections includes a groove close to the back section and an slot far away from the back section, the slot is connected through to the groove, a first antenna unit and a second antenna unit are defined at the side section by the groove and the slot; and a separator located in the groove and the slot; and a circuit board located between the front cover and the back cover.

2. The portable electronic device of claim 1, wherein the material of the back section and the side sections are metal, and the back section and the side sections are integratedly formed.

3. The portable electronic device of claim 1, wherein the side sections include two first side sections and two second side sections, the first side section is longer than the second side section, and most part of the first antenna unit and the second antenna unit are located in the second side section.

4. The portable electronic device of claim 1, wherein the length ratio between the first antenna unit and the second antenna unit is between 3:1 to 5:1.

5. The portable electronic device of claim 1, wherein the first antenna unit has a turn at a position close to the second antenna unit to form a first section of the first antenna unit and a second section of the first antenna unit in parallel.

6. The portable electronic device of claim 1, wherein each of the first antenna unit and the second antenna unit are connected to an adjacent side section among the side sections, respectively.

7. The portable electronic device of claim 1, wherein the first antenna unit or the second antenna unit is separated from an adjacent side section of the side sections via the separator, respectively.

8. The portable electronic device of claim 1, further comprising:

a feeding metal piece connected to the circuit board and the first antenna unit.

9. The portable electronic device of claim 1, wherein the first antenna unit and the second antenna unit are connected to a plurality of grounding pad of the circuit board, respectively.

10. The portable electronic device of claim 1, further comprising:

a support board located at a side of the circuit board; and a coupling antenna located on the support board and configured adjacent to the first antenna unit or the second antenna unit and connected to a grounding pad of the circuit board.

* * * * *